US006276522B1

(12) United States Patent
Walter

(10) Patent No.: US 6,276,522 B1
(45) Date of Patent: Aug. 21, 2001

(54) PACK FOR SMOKING ARTICLES AND ASSOCIATED BLANK

(75) Inventor: Sidney John Walter, Addleston (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 09/254,464

(22) PCT Filed: Sep. 8, 1997

(86) PCT No.: PCT/GB97/02400

§ 371 Date: Mar. 5, 1999

§ 102(e) Date: Mar. 5, 1999

(87) PCT Pub. No.: WO98/11003

PCT Pub. Date: Mar. 19, 1998

(30) Foreign Application Priority Data

Sep. 10, 1996 (GB) ..... 9618898

(51) Int. Cl.[7] ..... B65D 85/10
(52) U.S. Cl. ..... 206/264; 206/273; 229/933
(58) Field of Search ..... 206/265, 268, 206/271, 273, 264; 229/149, 933

(56) References Cited

U.S. PATENT DOCUMENTS

| | | | | |
|---|---|---|---|---|
| 1,174,605 | * | 3/1916 | Palmer | 229/149 |
| 1,697,664 | | 1/1929 | Schweich . | |
| 1,948,181 | | 2/1934 | Medoff . | |
| 2,130,475 | | 9/1938 | Shouse . | |
| 2,133,590 | * | 10/1938 | Stopper | 229/149 |
| 2,931,554 | | 4/1960 | Matern . | |
| 3,708,109 | | 1/1973 | Rosenburgh, Jr. . | |
| 3,828,923 | * | 8/1974 | Phillips, Jr. | 206/273 |
| 3,897,900 | * | 8/1975 | Gorski et al. | 206/273 |
| 4,106,688 | * | 8/1978 | Berger et al. | 229/933 |
| 4,718,557 | * | 1/1988 | Friedman | 229/149 |
| 5,005,701 | * | 4/1991 | Dutcher | 229/162 |
| 5,379,889 | | 1/1995 | Cobler . | |

FOREIGN PATENT DOCUMENTS

| | | |
|---|---|---|
| 1 761 738 | 8/1971 | (DE) . |
| 702235 | 1/1954 | (GB) . |
| 880956 | 10/1961 | (GB) . |
| 1 330 270 | 9/1973 | (GB) . |

OTHER PUBLICATIONS

International Search Report for International Application No. PCT/GB97/024000 completed by EPO on Nov. 17, 1997.

* cited by examiner

*Primary Examiner*—Jim Foster
(74) *Attorney, Agent, or Firm*—Pitney, Hardin, Kipp & Szuch, LLP

(57) ABSTRACT

The invention relates to a non-hinge lid smoking article pack, blank and print layout therefor which blank and print layout utilize a reduced amount of cartonboard and have reduced cartonboard waste from the print layout arrangement. Attempts to maximize interdigitation of blanks is proposed, whereby a saving of about 10% or more of cartonboard usage over a conventional hinge-lid pack can be achieved.

18 Claims, 3 Drawing Sheets

PACK FOR SMOKING ARTICLES AND ASSOCIATED BLANK

This invention relates to smoking article packaging, and in particular cigarette or cigar packs or packages.

An effect of our more eco-friendly environment is the attention being paid to packaging waste associated with the articles to be packaged. A recent EC directive even goes so far as to impose a financial penalty on the amount of material wasted in a packaging print layout. A print layout is the way in which each blank for an article package is laid out on a predetermined width of packaging sheet material. Thus, not only do manufacturers wish to be able to provide packages which use the minimum amount of packaging material at the minimum weight for adequate product protection and pack strength but they also want to provide a package which on a print layout wastes the minimum amount of material.

In the tobacco industry cigarettes are commonly provided in hard cup or soft cup packs. Hard cup packs offer the maximum protection because they are made of cardboard, which is available in various weights, as specified. The most common cigarette hard cup pack is a hinge-lid pack, which usually has an inner frame located within the upper part of the pack. The inner frame may be produced as an integral part of the hinge-lid pack blank, but is most commonly produced as a separate blank from an additional reel of cardboard.

Relatively simple cigarette packs are known, for example, the packs described in GB 1 036 825, GB 880 956, GB 1 330 270 and DE 17 61 738. However, the blanks for these packs are not designed to provide maximum use of cartonboard and minimum waste of cartonboard in a print layout. All of the side walls are of double thickness in GB 1 036 825, GB 1 330 270 and DE 17 61 738, and in GB 880 956, the top and bottom walls are of double thickness. The blanks cannot be interdigitated with one another on a print layout, thus increasing waste and decreasing maximum usage of the cartonboard. Similarly, GB 1 475 684 depicts in FIGS. 5 to 7 an integral cartonboard blank with an upper wall opening arrangement. Once again, this arrangement has a high cartonboard usage and double thickness walls.

It is an object of the invention to provide an alternative to a hinge-lid smoking article pack, which pack alternative saves cartonboard for a blank and on a print layout.

It is a further object of the invention to provide a hard cup smoking article pack which in print layout has a reduced amount of cartonboard wastage, and hence a lower financial waste penalty to the manufacturer.

The present invention provides a smoking article pack blank comprising a front wall, a top wall, a rear wall and a bottom wall, said front wall and said rear wall being interconnected by said bottom wall, characterised in that each of said front wall and said rear wall has a single side wall depending from a side margin thereof, each of the two side walls being located depending from an opposing side margin of each of said front wall and said rear wall, each of said side two walls extending along the full length of said side margin of said front wall and said rear wall, and optional adjacent side flap depending from the other opposing side margin of each of the front wall and the rear wall, said side flap being of a width which is less than the width of said two side walls, one of said two side walls or said top wall having opening flap retaining means, and one or more of the other of said side walls or said top wall having one or more portions defining an opening flap and opening flap crease margin therein.

The present invention also provides a smoking article pack produced from said smoking article pack blank.

The terms front wall, top wall, rear wall and bottom wall do not imply any particular orientation of the pack and can equally well be replaced by the terms first wall, second wall, third wall and fourth wall respectively, where each occurs.

Preferably the side walls have an adjacent side flap attached thereto. In the alternative, a side wall depends from an opposing side margin of each of the front wall and rear walls, and a side flap depends from each of the other opposing side margins of the front wall and rear wall.

Preferably the margins of the opening flap are part of the crease margins of adjacent walls and those parts of the margins are perforated to enable the opening flap to be pulled back to the opening flap crease margin.

Advantageously the opening flap comprises an end portion which tapers, tapering aiding the opening flap to be located within the opening flap retaining means. The opening flap may comprise two portions, one portion in two adjacent walls.

Preferably the wall having the opening flap retaining means is also provided with opening flap removal means. Advantageously the opening flap removal means comprises a thumb cut. Advantageously the opening flap retaining means comprises a slit.

Advantageously, the one of said side walls or said top wall having opening flap retaining means is a side wall, and the one or more of said side walls or said top wall having a portion defining an opening flap and opening flap crease margin therein is a top wall and side wall or bottom wall and side wall.

Advantageously either the front wall or the rear wall has a margin from which depends an inner flap bottom wall. Preferably the inner flap bottom wall has a side flap depending from each of the inner flap bottom wall side margins.

Preferably, the top wall has an inner side flap at the side margin opposite to the opening flap. Advantageously the inner side flap, at that margin opposite the side margin of the top wall, is shaped such that an opening flap of an adjacent pack blank fits into the inner side flap shape and the combined width of the side wall portion of said opening flap extending from the top wall opening flap crease margin, and the minimum width of said inner flap being no greater than the combined width of one of said side walls and one of said side flaps.

The present invention further provides a print layout for a non-hinge lid smoking article pack, the print layout producing less than 22% waste material from a layout of about 478 mm by about 577 mm, the print layout comprising a plurality of smoking article pack blanks according to the invention.

The present invention further provides a print layout for a non-hinge lid smoking article pack, the print layout having at least a 10% saving in cartonboard usage over the print layout of a conventional smoking article hinge-lid pack, the print layout comprising a plurality of smoking article pack blanks according to the invention.

Advantageously the saving in cartonboard usage can be about 15% or more over a conventional hinge-lid pack, and there may also be similar savings for non-hinged packs.

The print layout for the blank of the present invention provides the same number of blanks from a board layout of about 478 mm (B in FIG. 3) by about 577 mm (A in FIG. 3) as from a conventional board area of about 480 mm by about 600 mm. Advantageously the preferred blank provides a layout of blanks which have all the cut and crease lines in parallel arrangement. The crease lines in particular all fall along three main horizontal lines and four main vertical lines (vertical being the longer length of the print layout). The print layout is also more suited to fast moving cigarette pack cartoning machines.

In order that the invention may be easily understood and readily carried into effect, reference will now be made, by way of example, to the accompanying diagrammatic drawings hereof, in which.

Figure 1:
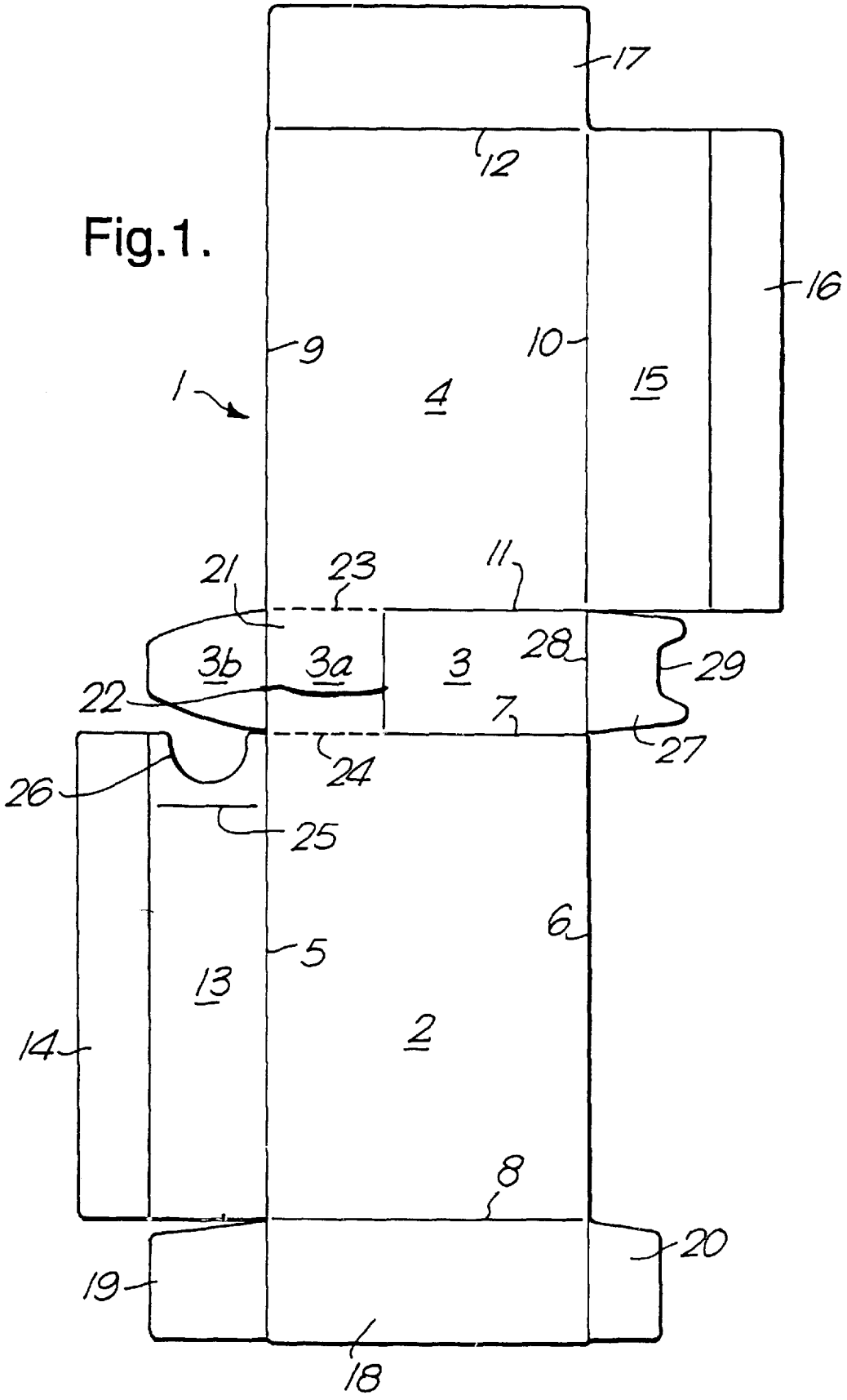
FIG. 1 shows a blank for a pack according to the invention.

In FIG. 1 there is depicted a blank 1 for a smoking article hard cup pack. The blank 1 comprises a front wall 2, a top wall 3 and rear wall 4. The front wall 2 has side margins 5 and 6, top margin 7 and bottom margin 8. Rear wall 4 has side margins 9 and 10, top margin 11 and bottom margin 12. A side wall 13 and side flap 14 depend from side margin 5 of the front wall 2. An opposing side margin 10 of the rear wall 4 has a side wall 15 and side flap 16 depending therefrom. Bottom wall 17 depends from bottom margin 12. An inner flap bottom wall 18 depends from bottom margin 8 of the front wall 2. Each side margin of the inner flap bottom wall 18 has a side flap 19,20 depending therefrom. Side flaps 14 and 16 are optional, as side margins 6 and 9 could have side flaps located therealong. This arrangement, though, may not give such good board saving on a print layout.

Top wall 3 has portion 3*a* and side wall 13 has portion 3*b* defining an opening flap 21. Top wall 3 has an opening flap crease margin 22. The margins 23, 24 of the opening flap 21 which are part of the crease margins of adjacent front and rear walls 2 and 4 are perforated to enable the opening flap 21 to be pulled back to the opening flap crease margin 22 to expose some of the smoking articles held within the pack. Portion 3*b* of, the opening flap 21 tapers towards an end portion, which enables the flap to be tucked into opening flap retaining means in side wall 13, which means in this instance is a slit 25. When the pack is erected the opening flap 21 is folded inside side wall 13 with portion 3*b* having been folded and positioned inside of side wall 13. Thus, in order to provide for ease of access to portion 3*b* of the opening flap 21 there is provided a thumb cut 26. The opening flap 21 is advantageously held in slit 25 or can be pushed inside the side wall 13, as when the pack is erected.

Top wall 3 has an inner side flap 27. The end of the inner side flap 27 remote the top crease margin 28 is shaped to provide two small prongs with a recessed inner part 29. The inner side flap 27 is shaped so that the tapered end of a portion 3*b* of an adjacent blank can fit within the recessed inner part 29.

When the pack is erected, inner side flap 27 is located inside side wall 15. Side flap 16 is located inside front wall 2 and side flap 14 is located inside rear wall 4. Inner flap bottom wall 18 and side flaps 19, 20 are located inside bottom wall 17.

Figure 2:
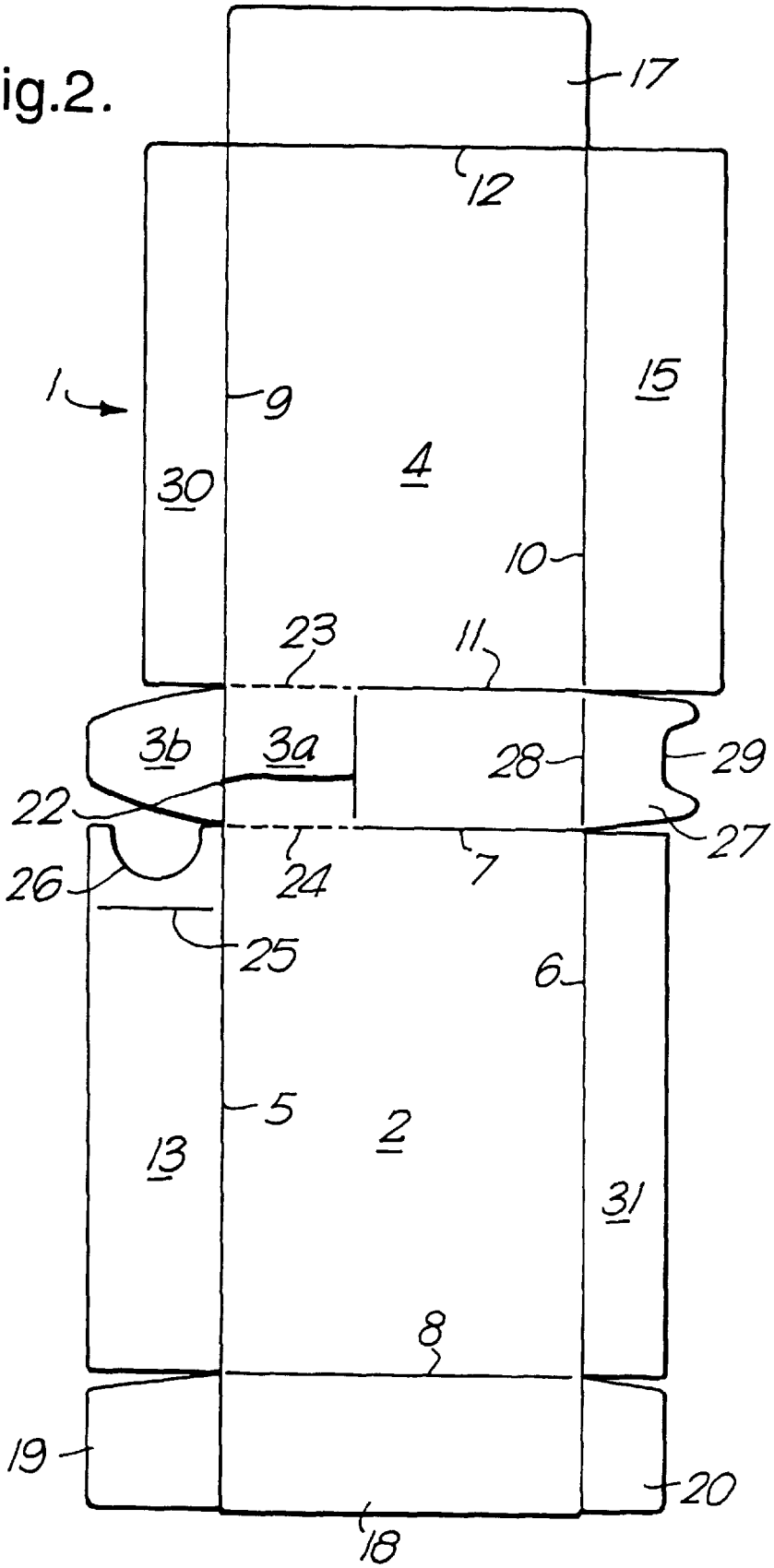
FIG. 2 shows an alternative blank for a pack according to the invention.

FIG. 2 shows a similar but alternative layout of a blank according to the invention. Like numerals have been assigned to the like parts of FIG. 1. The main difference is that side walls 15 and 13 do not have depending side flaps 14 and 16 attached thereto. Instead, side flaps 30 and 31 are found depending from opposed side margins 9 and 6 respectively. This arrangement also allows inter-nesting of blanks on a print layout (not shown).

Figure 3:
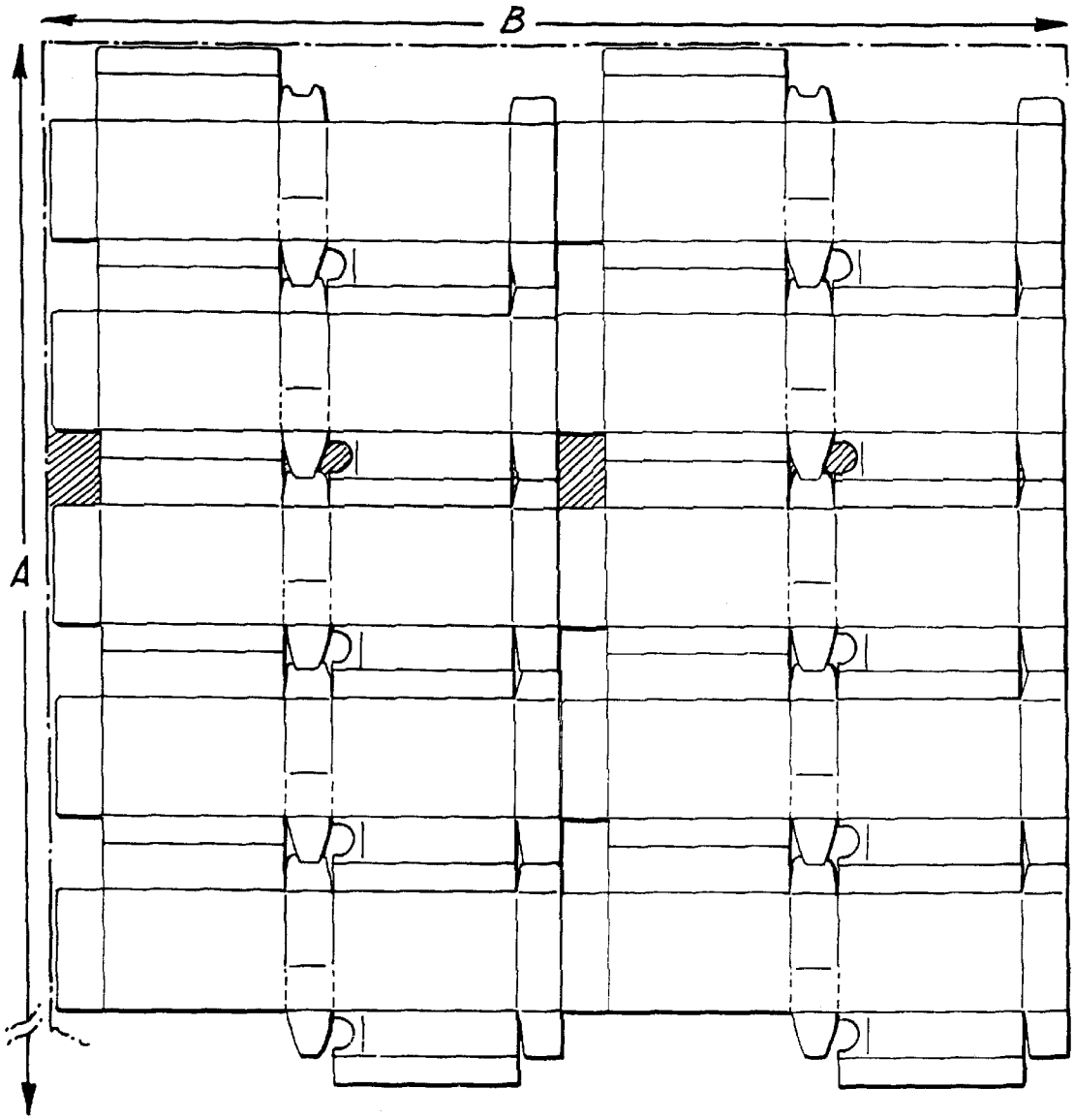
FIG. 3 shows the print layout for packs according to FIG. 1 of the invention.

FIG. 3 shows the print layout for pack blanks according to the invention. The dimensions are A: about 577 mm and B: about 477 mm. As can be seen therefrom only the shaded areas are found between each blank, thus substantially decreasing the waste board left from the print layout. On a comparison against a print layout over the same area for a conventional hinge-lid pack there is a cartonboard saving per pack of about 4.5% for flat bed printing (Litho) or 6% for Rotary printing (Gravure). When one takes into consideration the lack of an inner frame there is a further about 13% reduction in cartonboard usage over a hinge-lid pack, giving a total reduction in cartonboard usage of about 17.5% or about 19% respectively. This is a considerable cartonboard area saving. This saving in combination with the reduction in waste and hence a lower potential financial waste penalty offers considerable saving to a smoking article manufacturer, whilst still maintaining comparable or acceptable product protection.

Packs according to the invention require a relatively simple folding and gluing operation for machine packing. Furthermore, significant cartonboard savings occur for the layouts envisaged, even over more simple packs than the present day conventional hinge-lid pack. Savings of about 5% or more may be realised, and even about 10%, or more.

Filter savings can also accrue consequent to the smaller pack size, namely a decrease in the amount of overwrap film, a smaller 200's carton unit and a consequently smaller case for the cartons.

As mentioned above the weight of the cartonboard may be reduced for an acceptable pack strength. This would give an increased saving on cartonboard weight over conventional hinge-lid pack cartonboard weight and other more simple packs.

What is claimed is:

1. A smoking article pack blank comprising a front wall, a top wall, a rear wall and a bottom wall, said front wall and said rear wall being interconnected by said top wall, each of said front wall and said rear wall having a single side wall depending from a side margin thereof, each of the two side walls being located depending from an opposing side margin of each of said front wall and said rear wall, said top wall having one or more portions defining an opening flap and opening flap crease margin therein, each of said two side walls extending along the full length of said side margin of said front wall and said rear wall, side flaps each depend either from the other opposing side margin of each of said front wall and said rear wall, or one each of said side flaps being attached to a side wall, said side wall adjacent said opening flap having opening flap retaining means, said top wall having an inner side flap at the side margin opposite to said opening flap, and the combined width of the side wall portion of said opening flap extending from the top wall opening flap crease margin, and the minimum width of said inner side flap being no greater than the combined width of one of said sidewalls and one of said side flaps.

2. A smoking article pack blank according to claim 1, wherein said side walls have an adjacent side flap attached thereto.

3. A smoking article pack blank according to claim 1, wherein a side flap depends from each of the other opposing side margins of said front and rear walls.

4. A smoking article pack blank according to claim 1, wherein the margins of the opening flap are part of the crease margins of adjacent walls.

5. A smoking article pack blank according to claim 4, wherein said parts of said margins are perforated to enable said opening flap to be pulled back to the opening flap crease margin.

6. A smoking article pack blank according to claim 1, wherein said opening flap comprises an end portion which tapers.

7. A smoking article pack blank according to claim 1, wherein said opening flap comprises two portions, one portion in each of two adjacent walls when the blank is folded to form said pack.

8. A smoking article pack blank according to claim 1, wherein said wall having said opening flap retaining means is also provided with opening flap removal means.

9. A smoking article pack blank according to claim 8, wherein said opening flap removal means comprises a thumb cut.

10. A smoking article pack blank according to claim 8, wherein said opening flap retaining means comprises a slit.

11. A smoking article pack blank according to claim 9, wherein said opening flap retaining means comprises a slit.

12. A smoking article pack blank according to claim 1, wherein either said front wall or said rear wall has a margin from which depends an inner flap bottom wall.

13. A smoking article pack blank according to claim 12, wherein said inner flap bottom wall has a side flap depending from each of the inner flap bottom wall side margins.

14. A smoking article pack blank according to claim 1, wherein said side flap is of a width which is about half the width of a side wall.

15. A smoking article pack blank according to claim 1, wherein said inner side flap, at that margin opposite said side margin of said top wall, is shaped such that an opening flap of an adjacent pack blank fits into said inner side flap shape.

16. A smoking article pack produced from a smoking article pack blank according to claim 1.

17. A non-hinge lid smoking article pack print layout, said print layout producing less than 22% waste material from a layout of about 478 mm to about 577 mm, said print layout comprising a plurality of smoking article pack blanks according to claim 1.

18. A non-hinge lid smoking article pack print layout, said print layout having at least 10% saving in cartonboard usage compared with the cartonboard usage of the print layout of a conventional smoking article hinge-lid pack for the same product, said print layout comprising a plurality of smoking article pack blanks according to claim 1.

* * * * *